US007004785B2

(12) United States Patent
Melton et al.

(10) Patent No.: US 7,004,785 B2
(45) Date of Patent: Feb. 28, 2006

(54) CORD WRAP FOR CLIPPERS

(75) Inventors: Scott A. Melton, Erie, IL (US); James E. McCambridge, Polo, IL (US); Raymond A. Nielsen, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 164 days.

(21) Appl. No.: 10/624,219

(22) Filed: Jul. 22, 2003

(65) Prior Publication Data

US 2005/0015995 A1 Jan. 27, 2005

(51) Int. Cl.
*H01R 13/72* (2006.01)

(52) U.S. Cl. ..... 439/501; 30/216; 242/405.1

(58) Field of Classification Search ..... 439/500, 439/501, 371; 191/12 R; 174/91, 93, 135; 30/210, 216
See application file for complete search history.

(56) References Cited

U.S. PATENT DOCUMENTS 2,383,031 A * 8/1945 Wilson ..... 30/34.05
2,693,001 A * 11/1954 Vance ..... 15/323
3,111,573 A * 11/1963 Crowe et al. ..... 392/363
3,111,753 A * 11/1963 Seibold ..... 30/34.05
3,593,950 A 7/1971 Tetzlaff
3,901,458 A * 8/1975 Kuncz, Jr. ..... 242/405.2
4,047,299 A * 9/1977 Bair ..... 30/276
4,204,738 A 5/1980 Tillotson
4,233,733 A * 11/1980 Gallanis et al. ..... 30/43.92
4,274,199 A * 6/1981 Gallanis et al. ..... 30/34.1
4,308,878 A * 1/1982 Silva ..... 132/232
4,472,860 A * 9/1984 Osterlind ..... 24/129 R
4,658,465 A * 4/1987 Keane et al. ..... 15/323
4,724,614 A * 2/1988 Wahl et al. ..... 30/200
4,875,879 A 10/1989 Bunyea et al.
5,318,158 A 6/1994 Seasholtz
5,330,138 A * 7/1994 Schlessmann ..... 248/52
5,412,879 A * 5/1995 Wu ..... 34/97
5,531,333 A * 7/1996 Vara ..... 211/26
5,620,336 A 4/1997 Worthing
5,713,758 A 2/1998 Goodin et al.
5,727,745 A 3/1998 Vara
5,819,894 A * 10/1998 Okamoto ..... 191/12.4
5,901,712 A * 5/1999 St. Peter ..... 132/232
5,957,721 A 9/1999 Searle et al.
5,961,062 A * 10/1999 Beihl ..... 242/400.1
6,176,729 B1 1/2001 Myers
6,443,753 B1 9/2002 Bludis et al.
6,443,762 B1 9/2002 Lessig, III
6,484,787 B1 * 11/2002 Walters ..... 160/178.1 R
6,698,560 B1 * 3/2004 Reardon et al. ..... 191/12 R

* cited by examiner

*Primary Examiner*—Tho D. Ta
*Assistant Examiner*—Larisa Tsukerman
(74) *Attorney, Agent, or Firm*—Greer, Burns & Crain, LTD

(57) ABSTRACT

A cord wrap for use with a clipper is provided. The cord wrap accommodates a power cord associated with the clipper and has at least one retaining structure for retaining the power cord on the clipper. Provided on the at least one retaining structure is a cord channel which supports at least one loop of the cord.

22 Claims, 5 Drawing Sheets

CORD WRAP FOR CLIPPERS

BACKGROUND OF THE INVENTION

The present invention relates generally to portable electric appliances designed for use with power cords such as electric hair clippers, and specifically, to an apparatus for securely retaining the power cord on the clipper in a way which reduces stress on the cord.

Conventional portable electric hair clippers, trimmers and the like, when not battery powered, are typically provided with a power cord which varies in length from about six inches to about 6 feet and may have varying gauges. Regardless of the gauge or length of the standard clipper cord, users often need to wrap or otherwise organize the power cord to store the clipper, such as in a clipper stand, on a workspace, in a "junk drawer" or other location, in an orderly manner when not in use. For example, when the power cord is extended, care must be taken to avoid tangling of the cord with storage location obstructions, which can cause damage to the cord. Care should also be taken to minimize the creation of sharp bends or kinks in the cord. In such cases, prolonged abuse due to cord handling can cause damage to the power cord such that the clipper is inoperable. In addition, a tangled cord can also take up excessive space in the storage location, rendering the space disorganized, unsightly and uninhabitable for other objects.

To address this problem, the power cord is typically wrapped in several loops or knotted, and secured with a tie or a rubber band by the user. While making a more organized and space-saving configuration, the cord still has a tendency to become damaged when the loop or the knot becomes separated from the clipper in the storage location. Strain on the cord, particularly at the point of juncture with the clipper, can occur when the power cord loop or knot gets caught on an obstruction in the storage location and pulls on the clipper. Another problem with looping or knotting the power cord is that the plug portion of the cord often projects awkwardly from the loop or knot. The plug is particularly susceptible to becoming caught on objects, which in turn, pulls on the loop and could cause the loop to untie or unknot.

Another disadvantage of the loop or knot is that it requires tight bends to be made in the power cord for a compact, space-saving configuration. Repetitive sharp bending stresses of this type cause stresses on the internal wiring of the cord and may result in kinking or fraying of the cords and/or short circuits.

Accordingly, there is a need for a cord wrap for an appliance such as a clipper which compactly organizes a power cord associated with the appliance when the appliance is not in use.

There is also a need for a cord wrap for a clipper which reduces stress on the cord.

Another need is for a cord wrap for a clipper which secures the cord to the clipper.

Still another need of the present invention is for a cord wrap for a clipper which accommodates a range of power cord gauges.

SUMMARY OF THE INVENTION

The above-listed needs are met or exceeded by the present cord wrap, which features a cord wrap for an appliance such as a clipper that compactly organizes a power cord associated with the appliance when the appliance is not in use. Furthermore, the cord wrap reduces stress on the cord to prevent damage to the cord. In addition, the cord wrap secures the cord to the tool and accommodates a range of power cord gauges.

More specifically, a cord wrap for use with a clipper is provided. The cord wrap accommodates a power cord associated with the clipper and has at least one retaining structure for retaining the power cord on the clipper. Provided on the at least one retaining structure is a cord channel which supports at least one loop of the cord.

In an alternate embodiment, the cord wrap that accommodates a power cord for use with a clipper has a retaining structure with a front end and a rear end. A support is disposed between the front end and the rear end and connects the rear end with the front end. The retaining structure is also provided with a cord channel that supports at least one loop of the cord.

In another alternate embodiment, the cord wrap for use with a clipper that accommodates a power cord has a retaining structure with a front structure and a rear structure. The retaining structure further has a cord channel which supports at least one loop of the cord. A clip portion is also provided on the retaining structure and engages the clipper.

DETAILED DESCRIPTION OF THE INVENTION

Figure 1:
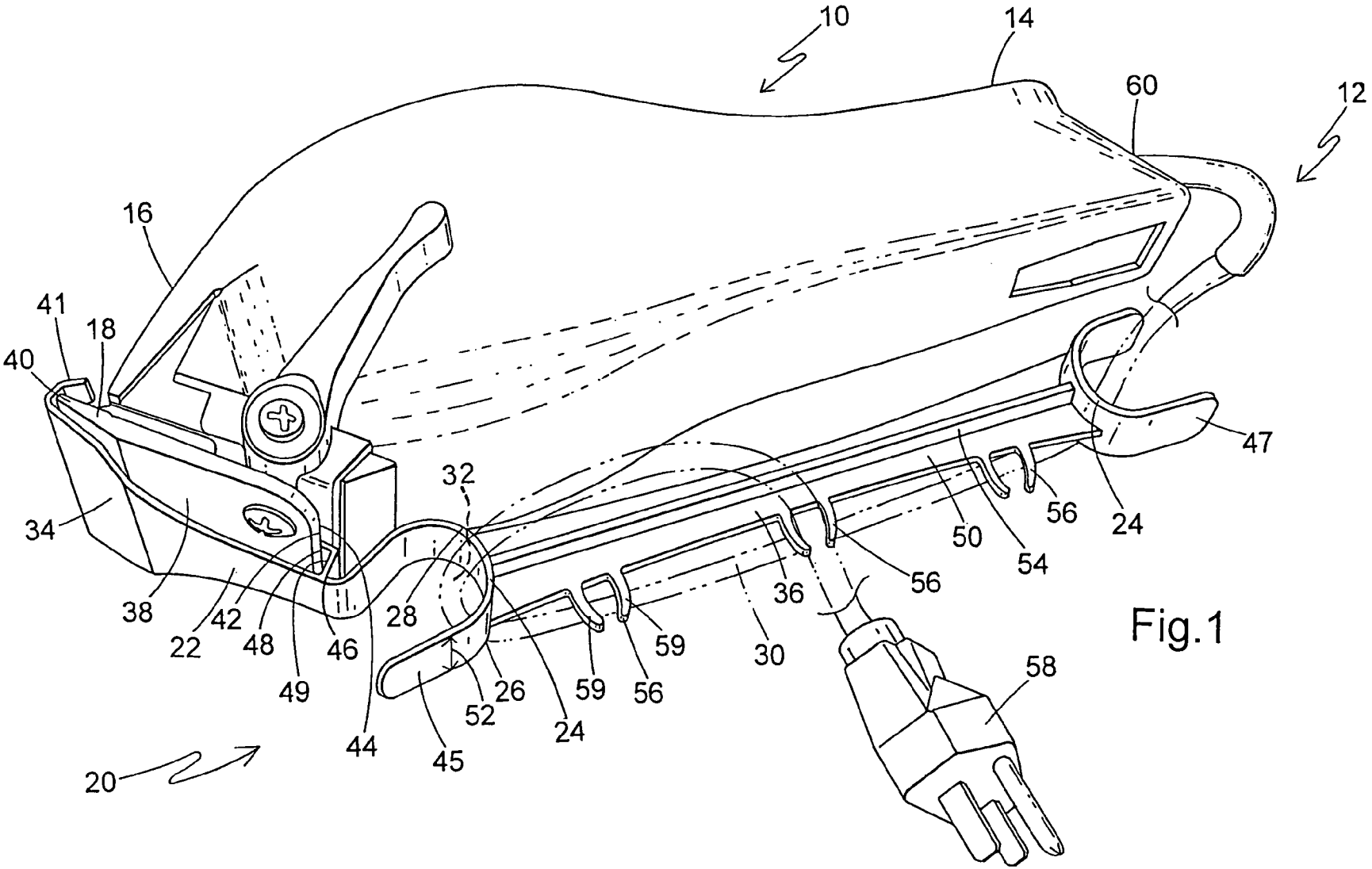
FIG. 1 is a side perspective view of a clipper incorporating the present one-piece cord wrap.
Figure 2:
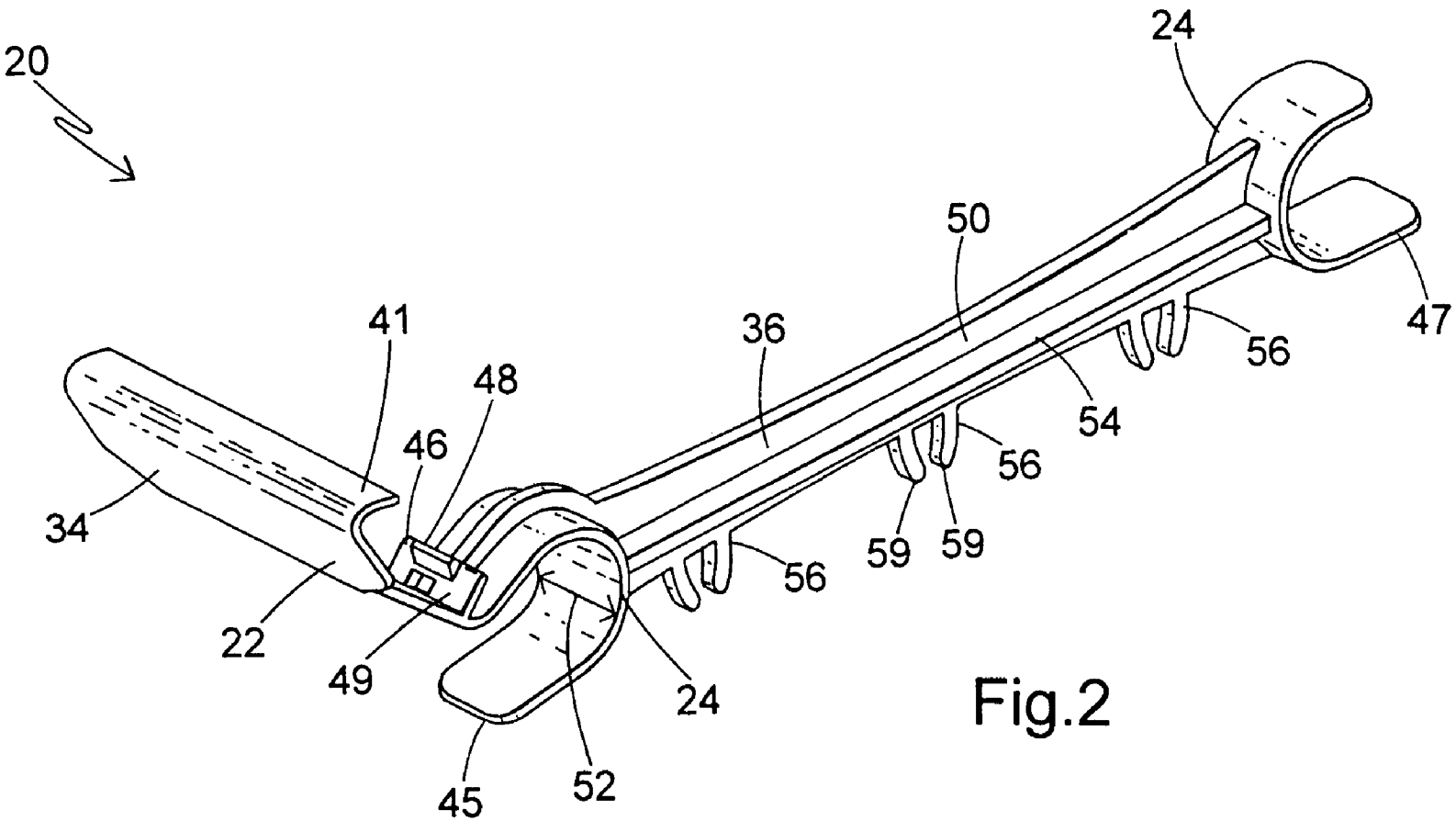
FIG. 2 is a front perspective view of the one-piece cord wrap of FIG. 1.

Referring now to FIGS. 1 and 2, a clipper generally designated 10 is contemplated as being any one of a group of commonly known electric devices including, but not limited to hair dryers, power drills, power screwdrivers, saws, and particularly devices using a bladeset, such as trimmers, razors, and the like, all being commercial or homeowner-type electric devices commonly used with a power cord, generally designated 12. The power cord 12 is of the type commonly used in conjunction with wall sockets. The length of the cord 12 may vary as well as its gauge or diameter and still be suitable for use with the present cord wrap.

The clipper 10 has a handle end 14 and a working end 16. In the preferred embodiment, the handle end 14 is made of molded rigid plastic, however, other suitable materials are contemplated such as cast aluminum, stainless steel, etc. as are well known in the art. Opposite the handle end 14, the working end 16 includes an apparatus for performing a task, such as a bladeset 18.

In the preferred embodiment, a cord wrap, generally designated 20, is secured to the working end 16 as by being snapped onto the bladeset 18. The cord wrap 20 is preferably molded rigid plastic, but any other material suitable for its function is contemplated. Two main components make up the cord wrap 20, a retaining structure 22 and a chord channel 24. In the preferred embodiment, the retaining structure 22 takes the form of a conventional blade guard which is removable from the bladeset 18 prior to clipping and is configured for retaining the power cord 12 in looped fashion at at least two points of contact 26, 28, with a looped portion 30 of the cord formed between the two points. The cord channel 24 receives and supports an apex 32 of the loop portion 30.

Included on the retaining structure 22 is a blade guard portion 34 and a lower portion 36. The blade guard portion 34 is configured for being adjacent to at least a first surface 38 of the bladeset 18 and projecting past and around teeth 40 of the bladeset with a lip 41. While other configurations are contemplated, in the preferred embodiment the blade guard portion 34 is generally shaped to correspond to the shape of the bladeset 18. A second or rear surface 42 of the bladeset 18 is located opposite the teeth 40 and is generally perpendicular to the first surface 38. Provided under the bladeset 18 and adjacent the second surface 42 is an aperture 44 for receiving an anchor 46 of the retaining structure 22.

Having a generally perpendicular alignment with the blade guard portion 34, the anchor 46 is generally "L"-shaped in profile such that a first leg 48 of the anchor is snapped into engagement with the aperture 44. A second leg 49 is generally perpendicular to both the first leg 48 and the blade guard portion 34 and is located adjacent to the second surface 42 of the bladeset 18.

Located on the lower portion 36 of the retaining structure 22 are first and second ends also termed front and rear ends 45, 47. The cord channel 24 at the front end 45 outwardly opposes the cord channel at the rear end 47 and is generally flat in a direction transverse to a longitudinal axis of the lower portion 36. Alternatively, it is also contemplated that at least one and preferably both of the ends 45, 47 define a cord channel 24 that is configured with a fully radiused or rounded edge to prevent unnecessary wear or stress on the power cord 12. Between the front and rear ends 45, 47 is a cantilever support 50 which extends from the front end and supports the rear end.

An important feature of the cord channel 24 is that it supports the apex 32 of the loop portion 30 at two spaced locations to avoid sharp bends. To that end, the cord channel 24 preferably has a width 52 (FIG. 2) that accommodates the power cord 12 without subjecting it to sharp bends. In the preferred embodiment, the cord channel 24 is arcuate or generally "C"-shaped along its vertical dimension at both ends 45, 47 to accept at least one, but preferably several, various profiles of the power cord 12 as known in the art.

Reinforcing the cantilever support 50 are ribs 54 which are preferably centrally disposed along the length of the support on both sides. The ribs 54 are generally perpendicular to the support 50 and are preferably integrally formed with the support. Other support structures are contemplated. Also preferably integrally formed with the support 50 are plug holders or clamps 56 spaced a distance apart along the support 50 for retaining the power cord plug 58.

In the preferred embodiment, the clamps 56 are disposed in the same plane, however other arrangements are contemplated depending on the application. When the power cord 12 is looped around the cord wrap 20 and retained in the cord channel 24, a portion of the cord adjacent the plug 58 is placed between opposing clamp fingers 59. In this manner, the plug 58 is stored near the clipper 10 and the looping configuration of the cord 12 is prevented from unraveling. Also, the plug holder 56 can be used to attach the cord wrap 20 to the power cord 12 so that the cord wrap is not misplaced when the clipper 10 is being used. In the preferred embodiment, three clamps 56 are equally spaced on the support 50 to accommodate the various lengths of cord and tightness of looping. It is also contemplated that any number and form of plug holders may be used, and should not be limited to clamps but should include recesses in the support, straps, or any other retaining means.

It will be seen that the clipper 10 defines a longitudinal axis, and the lower portion 36 of the retaining structure 22 is preferably oriented on the clipper 10 so that the lower portion is generally parallel to the longitudinal axis of the clipper. It is also contemplated that, in some cases, the lower portion 36 is not parallel to the clipper 10, but is skewed. Additionally, it is also contemplated that the lower portion 36 is located above, to the side, or in some other orientation relative to the clipper 10. While the "C" shape of the cord channel 24 is shown preferably oriented vertically, it is contemplated that other positions may be suitable, such as by orienting the cord channel at another angle with respect to the lower portion 36. Similarly, while the retaining structure 22 is shown preferably positioned on the working end 16 of the tool 10, it is contemplated that other positions may be suitable, including positioning the retaining structure 22 on the handle end 14.

Another aspect of the retaining structure 22 is that it preferably extends in close proximity to an electrical port 60 where the power cord 12 is fixedly attached to the handle end 14, however other configurations are contemplated. In this configuration, the power cord 12 further supports the cantilevered support 50 as the cord exits the clipper 10 and wraps around the rear end 47. Thus, when the cord 12 is wrapped around the rear end 47, the cord may suspend the cantilevered support 50.

Figure 3:
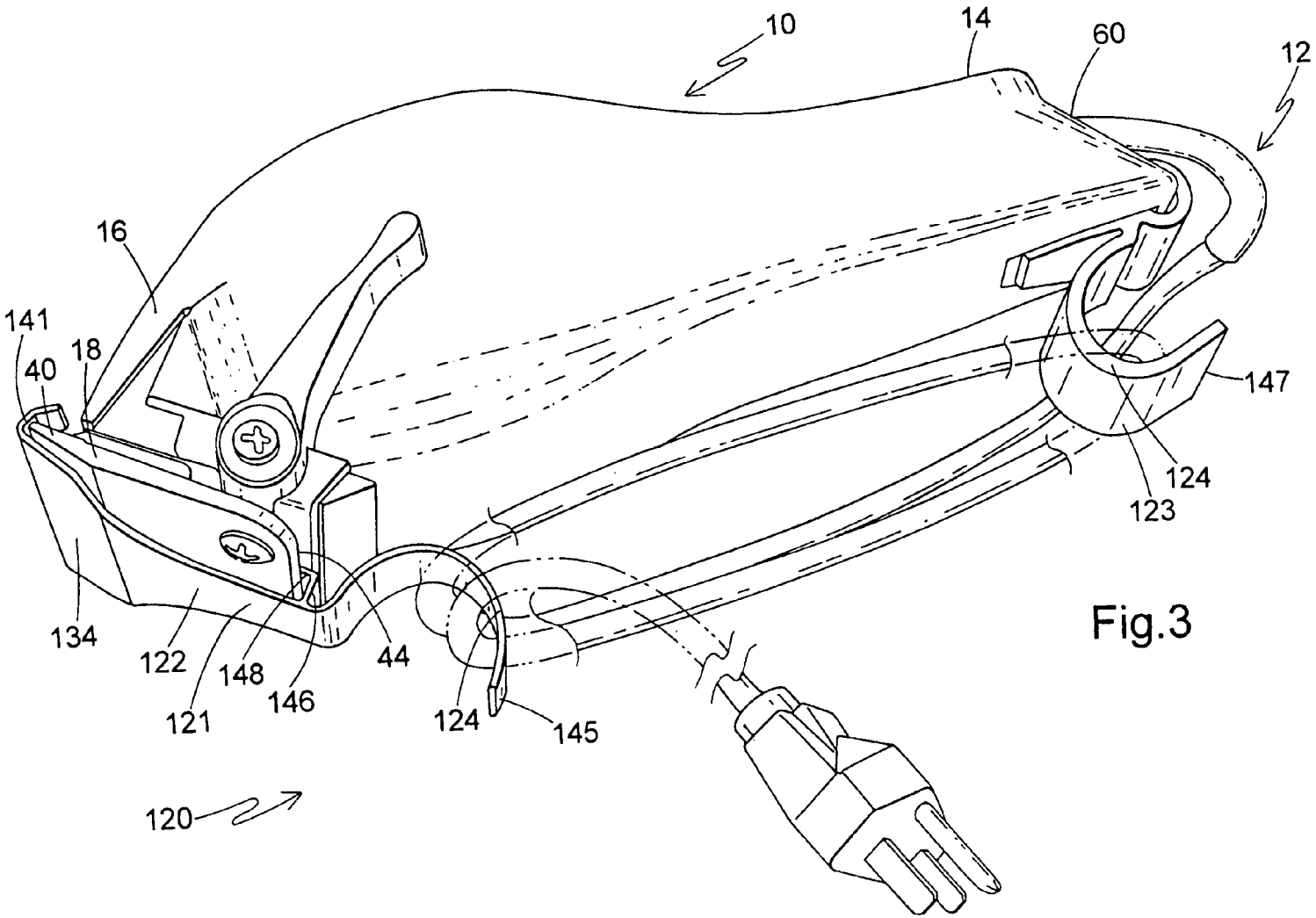
FIG. 3 is a side perspective view of the clipper of FIG. 1 incorporating the present two-piece cord wrap.

Referring now to FIG. 3, a two-piece embodiment of the present cord wrap is generally designated 120 and is generally similar to the first embodiment 20 except that it incorporates two pieces and lacks a cantilevered support 50. Like components of cord wraps 20 and 120 have been designated with the same reference numbers, provided that cord wrap 120 has numbers in the 100 series. In this embodiment, the retaining structure 121 includes a front retaining structure 122 and a rear retaining structure 123 which are secured to the working end 16 and the handle end 14, respectively, as by being snapped onto the clipper 10. The two retaining structures 122, 123 are configured for retaining the power cord 12 at at least two points of contact, 126, 128, with a loop portion 130 of the cord formed between the points.

The retaining structure 122 includes a blade guard portion 134 and a generally curved lower portion 136. Similar to the one-piece embodiment, the blade guard portion 134 is generally shaped to correspond to the shape of the bladeset 18 and projects over and around the teeth 40 with a lip 141. Additionally, the retaining structure 122 snaps into engagement with the clipper 10 by inserting a leg 148 of an anchor 146 into an aperture 44 located beneath the bladeset 18.

Located on the lower portion 136 of the retaining structure 122 is a front end 145 having a cord channel 124. In the preferred embodiment, the cord channel 124 is generally arcuate or "C"-shaped along its vertical dimension, but is contemplated as having other profiles and orientations.

Figure 4:
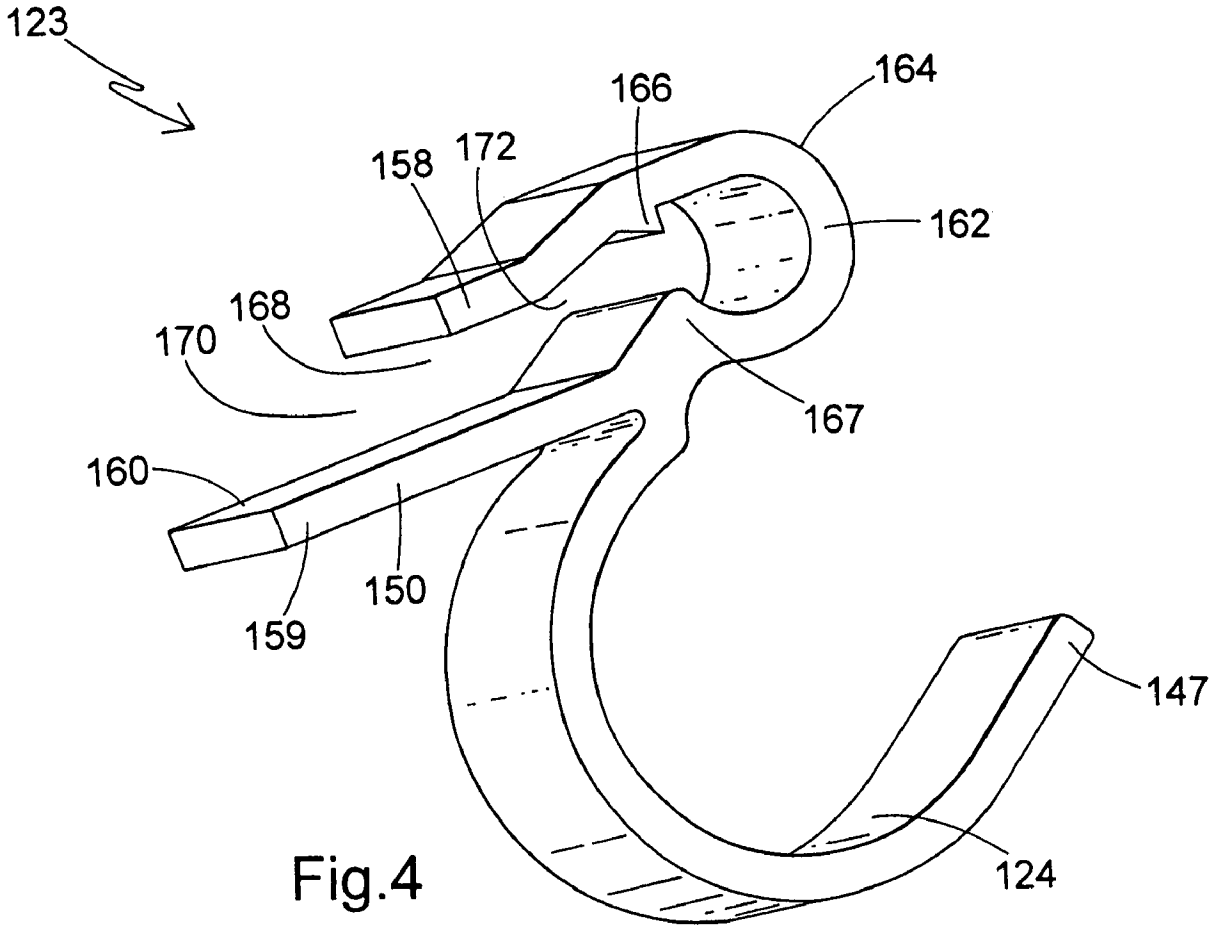
FIG. 4 is a side perspective view of the rear retaining structure of the two-piece cord wrap of FIG. 3.
Figure 6:
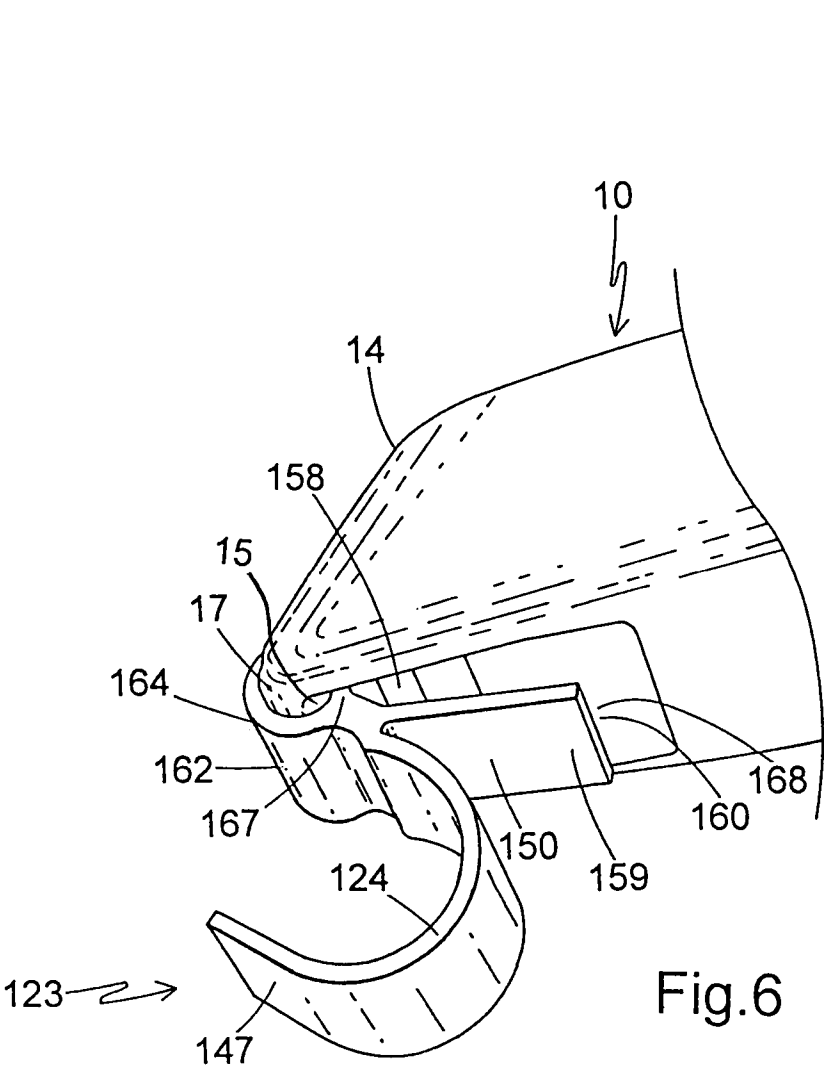
FIG. 6 is a fragmentary bottom perspective view of the clipper of FIG. 1 incorporating the rear piece of the two-piece cord wrap of FIG. 3.
Figure 5:
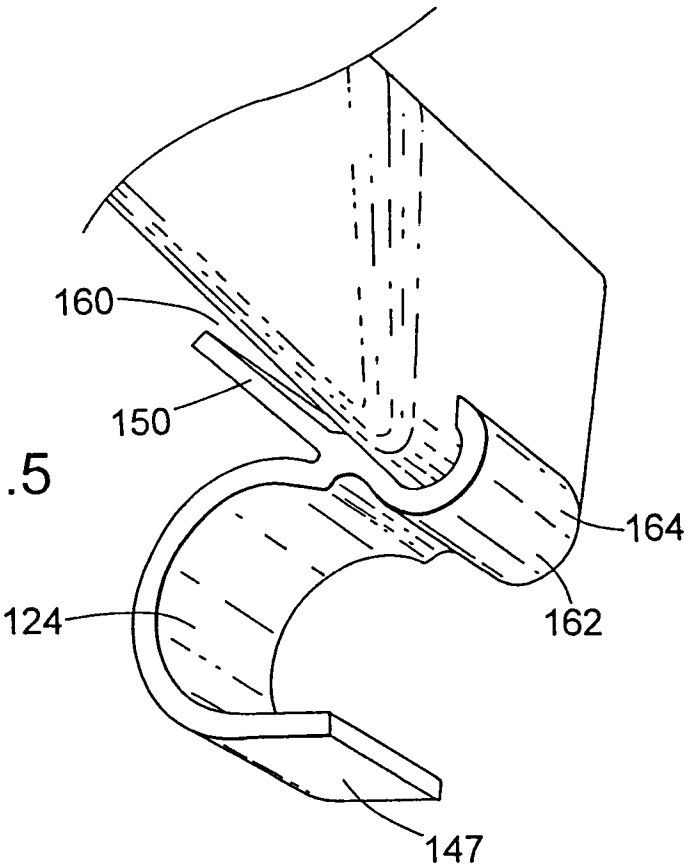
FIG. 5 is a fragmentary side perspective view of the clipper of FIG. 1 incorporating the rear piece of the two piece cord wrap of FIG. 3.

Referring now to FIGS. 4–6, the rear retaining structure 123 has a clip portion 150 and a rear end 147 which defines the cord channel 124. Preferably, the clip portion 150 incorporates two opposing elongate legs 158, 159 that may be biased towards each other. The clip portion 150 has an open end 160 and a closed end 162, the closed end 162 has circular hinge 164, but any shape that accommodates the handle end 14 and maintains the relative positioning of the elongate legs 158, 159 is contemplated.

A handle aperture 15 is provided to the handle end 14 and is configured for receiving one of the elongate legs 158. In the preferred embodiment, the first elongate leg 158 is shorter than the second elongate leg 159 which lays along the body of the clipper 10. On the inside of each leg 158, 159 is a projection 166, 167 generally triangular in shape, the projection associated with the first leg 158 being smaller than an opposing projection associated with the second leg 159. The elongate legs 158, 159 and the projections 166, 167 form a passage 168 which is generally coaxial with the clipper body 12 at an entrance portion 170 and is angled with respect to the axis of the clipper at a slanted portion 172.

When the clip portion 150 is introduced to the clipper 10, a pin or rod member 17 located at the handle end 14 of the clipper enters the entrance portion 170 and travels through the slanted portion 172 and through the opposing projections 166, 167. When the member 17 reaches the hinge 164, the projections 166, 167 retain the member in the hinge and the clip portion 150 is securably engaged. The clip portion 150 can be removed from engagement with the clipper 10 by a pulling force coaxial with the clipper 10 sufficient for the projections 166, 167 to allow the member 17 to exit the passage 168.

Integrally formed or otherwise attached to the clip portion 150 is the rear end 147 defining a cord channel 124 which, like the front end 145, is generally "C"-shaped in profile. As is the case with the cord wrap 20, it is also contemplated that the rear end 147 may have a different shape than the front end 145, such as a cylinder, a cone, or any other shape that will retain the power cord 12 in a static position on the retaining structure 123.

While a particular embodiment of the present cord wrap for a clipper has been described herein, it will be appreciated by those skilled in the art that changes and modifications may be made thereto without departing from the invention in its broader aspects and as set forth in the following claims.

The invention claimed is:

1. A cord wrap for use with a clipper configured for accommodating a power cord, said cord wrap comprising:

at least one retaining structure configured for retaining the power cord on the clipper;

a cord channel disposed on said at least one retaining structure and configured for supporting at least one loop of the cord;

said at least one retaining structure includes a blade guard portion that is configured to extend along a first surface of a bladeset and project around teeth of the bladeset, and a lower portion of said retaining structure defining said cord channel; and said retaining structure having front and rear ends, and configured for orienting the cord looped around said front and rear ends to define an obtuse angle relative to said blade guard portion.

2. The cord wrap of claim 1 wherein said at least one retaining structure and said cord channel maintain the power cord in a plane generally parallel with a longitudinal clipper axis.

3. The cord wrap of claim 1 wherein said cord channel has a width sufficient to support the apex of said at least one loop of the power cord.

4. The cord wrap of claim 1 wherein said at least one retaining structure is removably attachable to one of a working end and a handle end.

5. The cord wrap of claim 1 wherein said at least one retaining structure is snappingly engageable upon the clipper.

6. The cord wrap of claim 1 further including a clip portion located on said at least one retaining structure and configured for engaging the clipper.

7. The cord wrap of claim 1 wherein said at least one retaining structure has at least one plug holder for securing a plug in said retaining structure.

8. The cord wrap of claim 1 further including a clip portion located on said at least one retaining structure configured for engaging the clipper.

9. The cord wrap of claim 1 wherein said retaining structure is provided in two structures, including a first structure associated with a bladeset of the clipper.

10. The cord wrap of claim 9 further wherein said cord channel is disposed on a front end and a rear end of said retaining structure, said cord channel being defined by members being arcuate in profile.

11. A cord wrap for use with a clipper configured for accommodating a power cord, said cord wrap comprising:

a retaining structure configured for retaining the power cord on the clipper and having a front end and a rear end;

a cord channel disposed on said retaining structure configured for supporting at least one loop of the cord;

a support disposed between said front end and said rear end of said retaining structure for connecting the rear end to the front end; and said retaining structure further includes an integrally formed blade guard portion; and at least one plug holder disposed between said front and rear ends for securing the cord adjacent a cord plug on said retaining structure for preventing the cord from unraveling from said cord channel.

12. The cord wrap of claim 11 further including ribs disposed on said support for reinforcing said support.

13. The cord wrap of claim 11 wherein said rear end is located near an electrical port and is configured to be supported by the power cord when the power cord is engaged in said cord channel at said rear end.

14. The cord wrap of claim 11 wherein said retaining structure is detachably engageable with the clipper.

15. The cord wrap of claim 11 wherein said cord channel is configured to receive and support at least one apex of said at least one cord loop.

16. A cord wrap for use with a clipper configured for accommodating a power cord, said cord wrap comprising:

at least one retaining structure configured for retaining the power cord on the clipper;

a cord channel disposed on said at least one retaining structure and configured for supporting at least one loop of the cord;

said at least one retaining structure is snappingly engageable upon the clipper; and said at least one retaining structure includes a blade guard portion that is configured to extend along a first surface of a bladeset and project around teeth of the bladeset, and a lower portion of said retaining structure defining said cord channel, said lower portion extending at an obtuse angle to said blade guard.

17. The cord wrap of claim 16 further including at least one clip portion is disposed on said retaining structure and configured for supportably engaging the clipper.

18. The cord wrap of claim 17 wherein said at least one clip portion is configured to be removable from the clipper.

19. The cord wrap of claim 16 wherein said front structure and said rear structure are configured for maintaining the power cord in a plane generally parallel with the clipper.

20. The cord wrap of claim 16 wherein said cord channel associated with said front structure outwardly opposes said cord channel associated with said rear structure.

21. The cord wrap of claim 11 wherein said at least one plug holder includes a series of linearly spaced clamps located on said retaining structure.

22. The cord wrap of claim 21 wherein said cord channel is "C"-shaped at said respective ends, and said series of clamps are spaced between said ends.

* * * * *